US005419787A

United States Patent [19]

Levi

[11] Patent Number: 5,419,787

[45] Date of Patent: May 30, 1995

[54] STRESS REDUCED INSULATOR

[75] Inventor: Mark W. Levi, Utica, N.Y.

[73] Assignee: The United States of America as represented by the Secretary of the Air Force, Washington, D.C.

[21] Appl. No.: 267,098

[22] Filed: Jun. 24, 1994

[51] Int. Cl.[6] ..... C22C 21/00

[52] U.S. Cl. ..... 148/217; 148/238; 420/528

[58] Field of Search ..... 148/217, 238; 420/533, 420/541, 542, 528

[56] References Cited

U.S. PATENT DOCUMENTS

| | | | |
|---|---|---|---|
| 1,224,362 | 5/1917 | Cooper | 75/138 |
| 2,018,143 | 10/1935 | McCarty et al. | 75/1 |
| 2,066,912 | 1/1937 | Ruben | 175/315 |
| 2,087,269 | 7/1937 | Stroup | 75/138 |
| 2,190,290 | 2/1940 | Kirsebom | 75/135 |
| 3,551,143 | 12/1970 | Marukawa et al. | 75/138 |
| 3,825,442 | 7/1974 | Moore | 117/212 |
| 3,839,084 | 10/1974 | Cho et al. | 117/215 |
| 3,856,647 | 12/1974 | Blachman | 204/192 |
| 3,949,275 | 4/1976 | Muenz | 317/101 A |
| 3,962,485 | 6/1976 | Anderson et al. | 427/9 |
| 3,997,339 | 12/1976 | Fickelscher | 75/138 |
| 4,056,457 | 11/1977 | Vossen, Jr. | 204/192 SP |
| 4,731,132 | 3/1988 | Alexander | 148/437 |
| 4,851,192 | 7/1989 | Baba et al. | 420/528 |
| 5,352,917 | 10/1994 | Ohmi | 257/410 |

OTHER PUBLICATIONS

Kudela et al., "Study of Nitridation Process of Aluminum-Magnesium Alloys", Kovove Materialy, pp. 724–736, Dec. 1979 Cl. 148/238.

*Primary Examiner*—Scott Kastler

*Attorney, Agent, or Firm*—William G. Auton; Jacob N. Erlich

[57] ABSTRACT

An insulating film with low thermal expansion characteristics is formed by depositing aluminum alloy materials in thin film form without the use of high temperatures and which can then be oxidized to create an insulating film which has low stress. A mixture of aluminum and magnesium oxides, known as spinel, has the proportions which are approximately correct for zero expansion when crystallization results from the oxidation.

6 Claims, No Drawings

STRESS REDUCED INSULATOR

STATEMENT OF GOVERNMENT INTEREST

The invention described herein may be manufactured and used by or for the Government for governmental purposes without the payment of any royalty thereon.

The purpose of this invention is to provide a method wherein materials can be deposited in thin film form without the use of excessively high temperatures, and which can then be oxidized to create an insulating film which has low stress.

BACKGROUND OF THE INVENTION

The present invention relates generally to alloys and metallic compositions more specifically the invention pertains to materials which will not expand during oxidation or nitridation and which, therefore are useful in the manufacture of semiconductor devices, electrical circuits, and optical elements.

Thin films for various semiconductor and optical uses have been formed upon a substrate for support. In the past, attempts have been made to create patterned aluminum films by oxidizing the portion of a film which was not to be aluminum, that is, selective oxidation of a film. The increase in volume in the oxidation process caused high stresses to be induced with resulting delamination which makes the product unusable.

The task of providing thin insulator films which are stress free is alleviated, to some extent by the systems disclosed in the following U.S. Patents, the disclosures of which are incorporated herein by reference:

U.S. Pat. No. 1,224,362 issued to Cooper;
U.S. Pat. No. 2,018,143 issued to McCarty et al;
U.S. Pat. No. 2,066,912 issued to Ruben;
U.S. Pat. No. 2,087,269 issued to Stroup;
U.S. Pat. No. 2,190,290 issued to Kirsebom;
U.S. Pat. No. 3,551,143 issued to Marukawa et al;
U.S. Pat. No. 3,825,442 issued to Moore;
U.S. Pat. No. 3,839,084 issued to Cho et al;
U.S. Pat. No. 3,856,647 issued to Blachman;
U.S. Pat. No. 3,949,275 issued to Muenz;
U.S. Pat. No. 3,962,485 issued to Anderson et al;
U.S. Pat. No. 3,997,339 issued to Fickelscher;
U.S. Pat. No. 4,731,132 issued to Alexander;
U.S. Pat. No. 4,056,457 issued to Vossen, Jr., and
U.S. Pat. No. 4,851,192 issued to Baba et al.

Blachman discloses multi-layer control of stress in thin films wherein molybdenum, when sputtered directly onto a substrate to which a controlled dc voltage was applied, could be laid down with low stress but relatively high resistivity. When a second layer of molybdenum is sputtered on the first layer at a different voltage, a thin film could be obtained having low stress as well as low resistivity.

Anderson et al disclose a method for forming uniform stress-free thin films of metals, semiconductors and insulators. A molybdenum grid-tantalum structure is prepared, and a collodion film is settled on the grid to form a flat surface upon which a film could be deposited such as an amorphous germanium film. Other materials are suggested but not disclosed.

Vossen, Jr. discloses a method of depositing low stress hafnium thin films by radio frequency sputtering the films on alumina or sapphire substrate at high deposition rates.

Moore discloses a method whereby film cracking is prevented by formation of a glass layer over a first layer having abrupt surface contours. The glass is heated sufficiently for plastic flow to around the edges and avoid cracking.

While the above-cited references are instructive, the task of providing stress free insulators represents an ongoing technological need. The present invention is intended to help satisfy that need.

SUMMARY OF THE INVENTION

The present invention is a method for depositing certain materials in thin film form without the use of high temperatures and which can then be oxidized to create an insulating film which has low stress. These insulating films are formed from compositions of matter which can be oxidized without significant expansion or contraction.

It is an object of the present invention to provide a low stress insulator film.

It is another object of the present invention to oxidize an aluminum alloy film, and yield thereby a thin insulator film which is subject to low thermal expansion, and low stress.

These objects together with other objects, features and advantages of the invention will become more readily apparent from the following detailed description. There are no drawings.

DETAILED DESCRIPTION OF THE PREFERRED EMBODIMENT

The present invention is a method for depositing certain materials in thin film form without the use of high temperatures and which can then be oxidized to create an insulating film which has low stress. These insulating films are formed from compositions of matter which can be oxidized without significant expansion or contraction.

The process described above may produce thin insulating films which experience low stress, because a crystallization results from oxidation in the film which is subject to low amounts of expansion.

In the past, attempts have been made to create patterned aluminum films by oxidizing only a portion of a film. Anodization was a usual method used for the oxidation. The increase of the volume in the oxidation process caused high stresses to be induced with resulting delamination; this makes the process unusable.

Calculations based on standard chemical data compilations have shown that each of the divalent elements Magnesium (Mg), Calcium (Ca) and Barium (Ba) has the property, that upon oxidation to crystal forms, a decrease in volume occurs. These are, respectively, about 20%, 34% and 31%. Consequently, a deposited film consisting of a mixture of one or more of those elements with Aluminum (Al) or any of the other easily oxidizable and easily depositable metals which expand upon oxidation will exhibit a negligible volume change upon oxidation. Proper proportions can be chosen experimentally. For the case of Mg and Al the proportions which will form spinel are approximately correct for zero expansion if single crystal or large polycrystals result from the oxidation. Excess expansion from partial or complete amorphization during oxidation can be compensated with increased proportions of the divalent components.

The choice of which divalent metals to use depends upon the chemical and physical properties needed in the resulting oxide. While calcium has the most volume decrease its oxide is more prone to reaction with water and/or carbon dioxide than is magnesium's oxide. Therefore magnesium is generally the preferred material.

The advantages of creating insulating and/or optical films by depositing of the metal mixture followed by oxidation are that the entire process can be done without imposing large thermal excursions upon the substrate which is to be coated. An additional advantage is that a patterned insulating film can be obtained by first patterning the metal. This can be done relatively easily by the lift-off process.

The reactivity of the divalent metals should give excellent adhesion of the metal film to the substrate and result in good chemical bonds of the resulting oxide films.

While a layer consisting, in places, of the oxide insulator with the balance metal can be created by a patterned oxidation, the metal may be unsuitable for conductors since it will contain a high proportion of the very reactive divalent component. Nevertheless, for usage in an inert or cold environment such construction will be useful.

A similar situation arises with the nitrides of the elements Magnesium and Calcium. Consequently these could also be used when nitridation is done rather than oxidation. Thus, alternative compositions can be found for the nitridation case or the nitro-oxidation case.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A process of creating a low stress alloy film, said process comprising the steps of:

selecting an alloy consisting of aluminum, which has positive expansion upon nitridation, and calcium, which has a negative expansion upon nitridation, said selecting step using aluminum and calcium since the positive expansion of aluminum under nitridation approximately equalling the negative expansion of calcium;

depositing said alloy as a film on a substrate; and subjecting at least portions of said film to nitridation.

2. The method of claim 1 wherein the subjecting of said film to nitridation results in a single crystal spinel.

3. The method of claim 1 wherein said alloy consists of one atom of calcium for each two atoms of aluminum.

4. A process of creating a low stress alloy film, said process comprising the steps of:

selecting an alloy consisting of aluminum, which has positive expansion upon nitridation, and barium, which has a negative expansion upon nitridation, said selecting step using aluminum and barium since the positive expansion of aluminum under nitridation approximately equalling the negative expansion of barium;

depositing said alloy as a film on a substrate; and subjecting at least portions of said film to nitridation.

5. The method of claim 4 wherein the subjecting of said film to nitridation results in a single crystal spinel.

6. The method of claim 4 wherein said alloy consists of one atom of barium for each two atoms of aluminum.

* * * * *